US007178190B2

(12) United States Patent
Jones et al.

(10) Patent No.: US 7,178,190 B2
(45) Date of Patent: Feb. 20, 2007

(54) EXTENDABLE IMPROVED CLEANING SYSTEM AND METHOD

(75) Inventors: Terry G. Jones, Austin, TX (US); Christian Gerard, Austin, TX (US); Philip Leveridge, Austin, TX (US)

(73) Assignee: CrowleyJones, LP, Austin, TX (US)

( * ) Notice: Subject to any disclaimer, the term of this patent is extended or adjusted under 35 U.S.C. 154(b) by 239 days.

(21) Appl. No.: 10/653,801

(22) Filed: Sep. 3, 2003

(65) Prior Publication Data

US 2005/0044648 A1 Mar. 3, 2005

(51) Int. Cl.
*A46B 7/02* (2006.01)
*A47L 13/12* (2006.01)

(52) U.S. Cl. ..... 15/172; 15/106; 15/117; 15/160

(58) Field of Classification Search ..... 15/106, 15/160, 172, 117
See application file for complete search history.

(56) References Cited

U.S. PATENT DOCUMENTS 1,555,630 A 9/1925 Brock
1,689,109 A 10/1928 Brock
2,740,147 A * 4/1956 Bailey ..... 15/160
2,921,327 A 1/1960 Kuehl
3,050,762 A 8/1962 Ballinger
3,405,418 A 10/1968 Carter et al.
4,845,800 A 7/1989 Pederson et al.
5,517,710 A * 5/1996 Hisey ..... 15/106
6,088,868 A 7/2000 Cerveny

* cited by examiner

*Primary Examiner*—Randall Chin
(74) *Attorney, Agent, or Firm*—The Law Office of H. Dale Langley, Jr. P.C.

(57) ABSTRACT

A system for cleaning includes a handle and a head having a cleaning surface. The head is connected to the handle and is extendable to selectively widen or narrow the cleaning surface. A gear is fixedly connected to the handle and rotatingly connected to the head, so that twist of the handle rotates the gear. A first series of extension gears operably connect to the gear, and a second series of extension gears also operably connect to the gear. Rotation of the gear via the handle, rotates the first series and the second series. A first head extension is operably connected to the first series, such that rotation of the first series swings the first head extension into laterally aligned extension of the head. A second head extension is operably connected to the second series, such that rotation of the second series swings the second head extension also into laterally aligned extension of the head. In such manner, twist of the handle rotates the gear, causing the first series and the second series to rotate, thereby swinging the first and second head extensions into laterally extended alignment in order to selectively widen (and conversely narrow) the cleaning surface of the head.

1 Claim, 8 Drawing Sheets

EXTENDABLE IMPROVED CLEANING SYSTEM AND METHOD

BACKGROUND OF THE INVENTION

The present invention generally relates to cleaning implements and, more particularly, relates to sweepers, brooms and related devices which are laterally extendable and have improved features and operations.

For many years, cleaning implements—e.g., brooms, squeegees, dusters—have not significantly changed. In fact, the basic tools for cleaning houses, offices, and other indoor and outdoor areas were long ago designed and commercialized. Certain improvements and added features have been designed for these devices, but the basic concepts of the conventional cleaning devices remain as long ago conceived.

Conventionally, sweepers and brooms have included an elongate handle, a cleaning head, and bristles or other sweeping elements. The conventional designs have rarely, if ever, included any mechanical elements. Moreover, the conventional designs have not provided for different arrangements or extensions of cleaning heads and features. Additionally, bristles and other cleaning elements of the conventional devices are overlooked as relatively non-durable and dispensable, and largely clean by means of capture and retention of matter via frayed or flagged edges of bristles and the like. When a conventional device becomes worn and frayed, then the device has been thrown out and a new device obtained. Also, the conventional devices have typically served for a single-purpose use, for example, a broom device is for sweeping and a separate mop device is for mopping. Multiple functions have not been incorporated in the conventional cleaning devices.

It would be a significant improvement in the art and technology to further improve cleaning devices, such as brooms, squeegees, swiffers, mops, dusters and the like. It would also be an improvement to provide new and improved aesthetic and functional elements to such devices, including for changing device configuration such as widening or narrowing of cleaning elements, heads, or surfaces of such devices. Additionally, it would be an improvement to provide more durable and more user-friendly and user-efficient cleaning of bristles or other elements of such devices, particularly bristles that more easily clean and release gathered matter and the like. Moreover, it would be a significant improvement in the art and technology to provide multi-use or multi-function cleaning devices, such as interchangeable features for sweeping, dusting, squeegee or mopping. The present invention provides numerous advantages and improvements, including improvements and nuances in the foregoing respects.

SUMMARY OF THE INVENTION

An embodiment of the invention is a system for cleaning. The system includes a handle and a head connected to the handle. The head includes a cleaning surface. The head is extendable to selectively widen (or conversely narrow) the cleaning surface.

Another embodiment of the invention is a system for cleaning. The system includes a handle, a head connected to the handle, and a plurality of bristles connected to and extending from the head. The plurality includes individual bristles having varied cross-sectional shapes.

Yet another embodiment of the invention is a system for cleaning. The system includes a handle, a head connected to the handle, a plurality of bristles connected to and extending from the head, and an anti-static material of individual ones of the plurality.

Another embodiment of the invention is a system for cleaning. The system includes a handle, a head connected to the handle, and a head cover. The head cover is slidingly engageable with the head and thereby provides different cleaning function than the head. For example, the head cover forms a squeegee blade.

A further embodiment of the invention is a method of cleaning. The method includes grasping a handle, moving the handle to move a cleaning head connected to the handle, and selectively widening and narrowing the cleaning head.

BRIEF DESCRIPTION OF THE DRAWINGS

The present invention is illustrated by way of example and not limitation in the accompanying figures, in which like references indicate similar elements, and in which.

DETAILED DESCRIPTION

Figure 1:
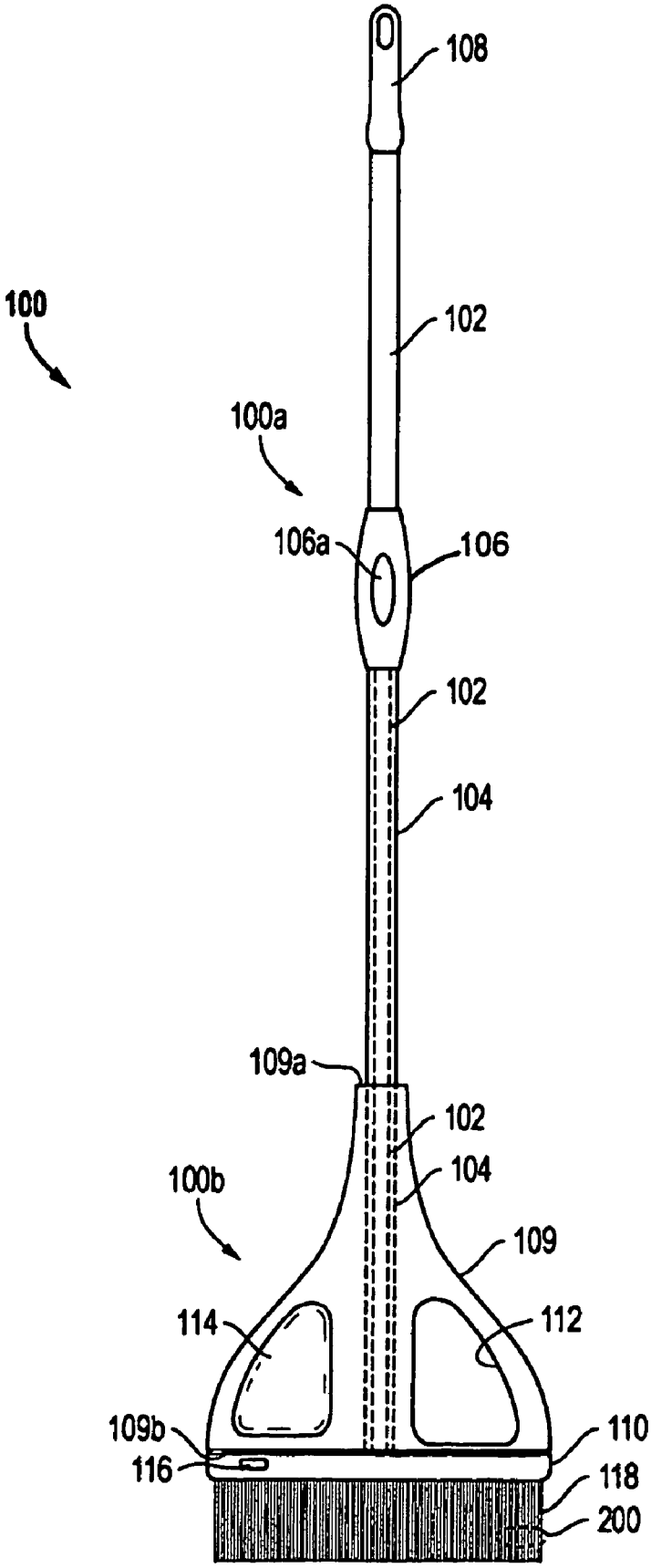
FIG. 1 illustrates a front view of a system for sweeping, according to certain embodiments of the invention.

Referring to FIG. 1, a system 100 for cleaning includes, generally, a handle 100*a* and a cleaning element 100*b*. The handle 100*a* includes a long pole 102 and a lower section 104. Each of the long pole 102 and the lower section 104 is a separate, longitudinally extending hollow tube or other lengthy extension. The long pole 102 extends through the lower section 104, longitudinally, such that the lower section 104 concentrically contains a lower portion of the long pole 102. The lower section 104 is of slightly larger diameter than that long pole 102, so that the lower section 104 is concentrically rotatable with respect to the long pole 102.

A grip 106 is fixed to the lower section 104 at an upper-most portion thereof, and located approximately midway of the length of the long pole 102. The grip 106 fixedly retains the lower section 104, and the long pole 102, on the one hand, and the grip 106 and lower section 104, on the other hand, are rotatable each with respect to the other. The grip 106 can include a manually operable button 106*a* or other element, which button 106*a* can selectively mate with holes (not shown) in the long pole 102 in order to rotatably orient and fix the long pole 102 with the lower section 104 in select 180° relative relations or in such other relative rotational positioning as may be desired according to the application.

At an upper end of the long pole 102, the long pole 102 is fixed with a grippable hanger 108. The hanger 108 includes an opening configured in the hanger 108. The opening of the hanger 108 permits storage of the system 100 on a hook or other device (not shown in FIG. 1) when the system 100 is not in use. The hanger 108 also serves as a comfortable grip for a user. For example, a user can hold the hanger 108 with one hand and the grip 106 with the other hand, for sweeping operations. Additionally, a user can rotate the long pole 102 with respect to the lower section 104 by gripping the hanger 108 with one hand and the grip 106 with the other hand, and then twisting in opposing directions. The button 106*a* of the grip 106 engages the mating holes of the long pole 102 whenever the system 100 is in extended or non-extended orientation, as hereinafter more fully described. By depressing the button 106*a* of the grip 106, the button 106*a* and the mating holes of the long pole 102 are disengaged, so that the lower section 104 and the long pole 102 are concentrically twistable with respect to each other.

The cleaning element 100*b* is formed with a head housing 109, having a narrow upper housing portion 109*a* for enclosing a lower end of the lower section 104 and a broader lower housing portion 109*b*. The lower housing portion 109*b* is laterally approximately the size of a conventional broom bristle surface, or other size as may be desired or applicable for the application. The upper housing portion 109*a* is slightly larger in size than a cross-section of the lower section 104, suitable for accepting and retaining the lower section 104 therethrough to permit free twisting rotation of the lower section 104 in the housing 109.

The lower section 104 is rotatable within the narrow portion of the cleaning element 100*b* within the housing 109 thereof. The lower section 104 extends into and down through the housing 109 of the cleaning element 100*b*, internally. Within the lower section 104, the long pole 102 also extends through the housing 109. The housing 109 of the cleaning element 100*b* broadens as it extends downwardly in FIG. 1. At a lower portion of the housing 109, a bristle head 110 is formed of the cleaning element 100*b*. The long pole 102 fixedly connects to the bristle head 110, for example, the long pole 102 is formed with threads at a lower end and the bristle head 110 includes a threaded socket for accepting the long pole 102. The lower section 104 fixedly connects to a primary gear (not shown in FIG. 1, but later shown and described in detail) rotatingly maintained in the bristle head 110.

As described, the bristle head 110 is connected to the long pole 102 and also via the primary gear or the bristle head 110 to the lower section 104, internally within the housing 109 (details are later discussed in conjunction with FIGS. 2–3). The bristle head 110 is also fixed with the housing 109 at the lower housing portion 109*b*. The lower housing portion 109*b* is so fixed with the bristle head 110 by tabs 114 and/or other snap mechanism engagement (not shown in detail). The bristle head 110 includes fixed bristles 118, as later discussed in more detail. The bristles 118 extend a suitable length, on the order of about 2" to about 6" or otherwise as desired or suitable for the application and use, from the bristle head 110. The bristles 118 form a cleaning surface, similar to that of a conventional broom.

Additionally, the bristle head 110 includes a button 116 or other push or mechanical mechanism. The button 116 serves to accept and retain an additional cleaning feature (not shown in FIG. 1), as later hereafter described.

The cleaning element 100 can include various other features, mechanisms, and elements, as desired or suitable for particular applications. For example, the head housing 109 can be formed with a grippable opening 112. The opening 112 can serve to accept a user's hand, in order to permit additional cleaning features or elements (later discussed) to be fixed to the housing 109. In any event, the lower portion 104 is rotatable within the housing 109 (and causes gears within the housing 109 to rotate), while the long pole 102 is fixed (non-rotatably) with the housing 109 by virtue of the fixed relation of the long pole 102 to the bristle head 110 via screw threads or otherwise (e.g., the bristle head 110 is snappably attached with the housing 109, so that the housing 109 and bristle head 110 remain in fixed relationship). Moreover, the head housing 109 can include rubber bumpers or other functional or aesthetic features. Rubber bumpers, for example, can facilitate use of the system 100 to prevent marring or scratching of cleaned surfaces and adjacent fixtures or other purposes.

Any of a wide variety of materials and pieces may form the system 100. The long pole 102 and lower portion 104 are, for example, cylindrical or otherwise longitudinally extending pieces, formed of light metal, aluminum, wood, composite, plastic or other materials. The grippable hanger 108 and the grip 106 are formed, for example, of plastic, rubber, or other materials suitably strong and resilient to fix with the long pole 102 and lower portion 104, respectively. Similarly, the head housing 109 of the cleaning element 100*b* is formed of resilient and strong plastic, rubber or other similar materials, with limited weight of such materials as a consideration. The bristle head 110 is formed of strong plastic, metal or other material sufficient for mechanical movement and gearings, as will later be more fully described and understood. The bristle head 110 is also formed sufficiently to retain and maintain, fixedly, the bristles 118.

Figure 2:
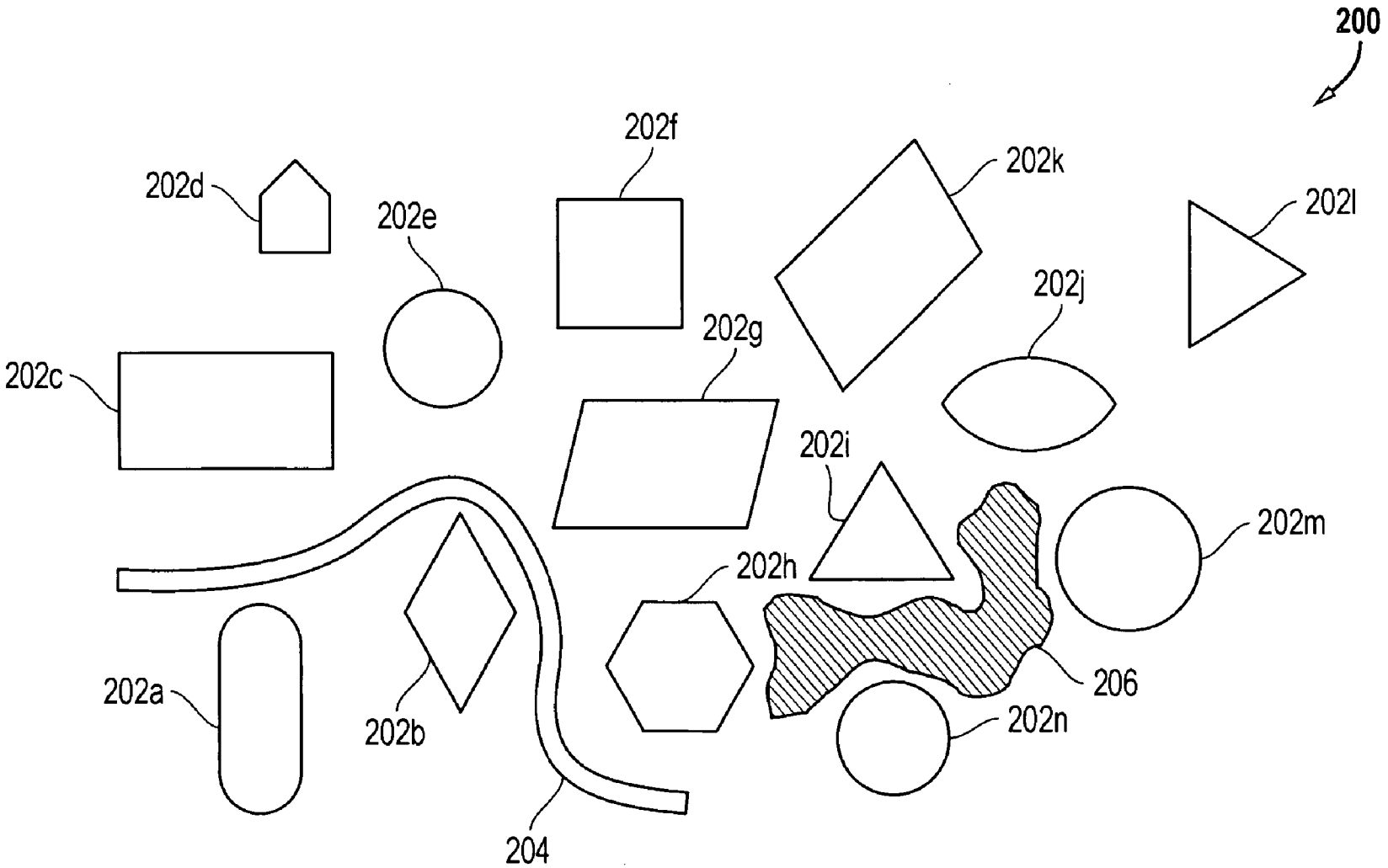
FIG. 2 illustrates a cross-sectional view of a portion of bristles (e.g., bristle cluster or packet) of a cleaning head of the system of FIG. 1, according to certain embodiments of the invention.

Referring to FIGS. 1 and 2, in conjunction, the bristles 118, themselves, are a significant aspect of the entire system 100. The bristles 118 are fixed with the bristle head 110 to extend downwardly (in FIG. 1) from the bristle head 110. The bristles 118 provide a cleaning surface for the system 100, similar to a conventional broom. The bristles 118 are unlike those of a conventional broom, however.

Particularly, with reference to FIG. 2, a cross section 200 of several individual ones of the bristles 118 shows that the individual ones of the bristles 118 have respective differentiated cross-section shapes, e.g., each an individual bristle 202*a*–202*n*. The lengths of the individual bristles 202*a*–202*n* are approximately the same in the system 100 of FIG. 1. Alternatively, the individual bristles 202*a*–202*n* can be varied or different in lengths, for example to narrow, angle, or form various configurations of the bristles 118, as a whole, according to desired arrangement.

Moreover, the cross-sectional shape of each of the individual bristles 202*a*–202*n* can variously differ. For example, although a number of different cross-sectional shapes are shown in FIG. 2, one or more of these different cross-sectional shapes, as well as a wide variety of other such shapes, comprise the bristles 202*a*–202*n*. The different cross-sectional shapes of the bristles 202*a*–202*n* are desirable so that the bristles 118, as a whole, operate to selectively and desirably retain and capture cleaned materials, such as, for example, a thread 204, a dust 206, and other such matter. The particular, varied cross-section shapes of the bristles 202*a*–202*n* retain the cleaned matter for purposes of cleaning, yet permit easy and ready release of the cleaned matter as desired. In an exemplary operation, the thread 204 and the dust 206 are each swept and captured by the bristles 202*a,b,c,e,g,h* and 202*h,i,j,m,n*, respectively. After cleaning, any retained matter of the bristles 202*a*–202*n* is easily shaken or dusted out of the bristles 202*a*–202*n*.

This aspect of the system 100 is in contrast to a conventional broom or similar sweeping device, which conventional device incurs or is designed with flagging (e.g, fraying along outer edges) of bristles. Such flagging captures cleaned materials, but does not readily release the materials as desired. For example, cleaned materials become entertwined and wrapped with the flagged bristles of conventional devices, sticking to the bristles—whereas the varied cross-sectional shapes of the bristles 202*a*–202*n* of the system 100 sufficiently retain and push matter for sweeping, but readily release the matter as desired because there is no sticking. In effect, the bristles 118 with the varied cross-sectional shapes of the bristles 202*a–n* push matter to be cleaned, but the matter does not substantially stick to or become entertwined with the bristles.

The bristles 118 (in FIG. 1), and shown in part as the bristles 202*a*–202*n* (in FIG. 2), are formed of resilient material, such as polypropylene or other sturdy materials for reduced flagging from extended use. Additionally, the bristles 118 can comprise an anti-static material or agent, such as certain anti-static coatings available now or in the future. In fact, the entire materials of the bristles 118 can themselves be a suitable anti-static material, according to the desired design and application.

Figure 3:
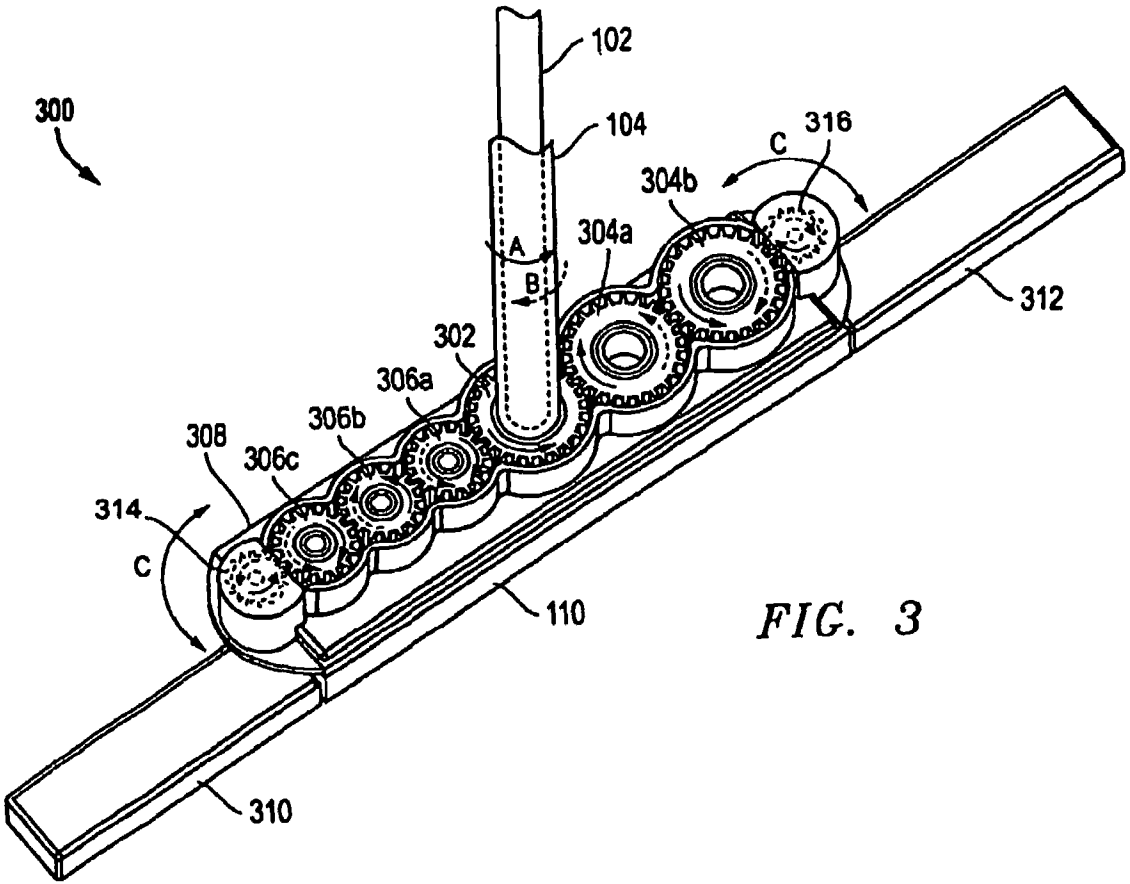
FIG. 3 illustrates a top, perspective view of an extension mechanism of the system of FIG. 1, according to certain embodiments of the invention.

Referring to FIG. 3, an extender 300 is included as the bristle head 110. The extender 300 connects fixedly to the long pole 102, for example, by screwing of the long pole 102 into securement with the extender 300, so that the extender 300 rotates with rotation of the long pole 102. The lower portion 104 also connects with the extender 300, but instead is fixedly connected with a primary gear 302 that is rotatingly maintained and positioned by the extender 300. The primary gear 302 of the extender 300 rotates (with respect to the long pole 102 and other portions of the extender 300), with rotation of the lower portion 104. As previously mentioned, the lower portion 104 is rotatable, by twist circumferentially along a longitudinal axis, within the narrow portion of the cleaning element 100*b* within the housing 109 thereof. As the lower portion 104 is so rotated, the primary gear 302 is consequently rotated.

The primary gear 302 fits with other gears of the extender 300, for example, dual large gears 304*a,b* and treble small gears 306*a,b,c*. The primary gear 302, the dual large gears 304*a,b*, and the treble small gears 306*a,b,c* are held in linear alignment via a gear rack 308 formed in the extender 300. The gear rack 308 of the extender 300 centrally holds, permitting rotation thereof with respect to the gear rack 308 and extender 300 generally, the primary gear 302, and also holds the dual large gears 304*a,b* on a first side and the treble small gears 306*a,b,c* on a second opposing side of the primary gear 302. The full-line arrows in FIG. 3 illustrate a rotation of the several gears 302, 304*a,b*, and 306*a,b,c* on rotation of the lower portion 104 in the direction of arrow A. The dotted-line arrows in FIG. 3 illustrate a rotation of the several gears 302, 304*a,b*, and 306*a,b,c* on the opposite rotation of the lower portion 104 in the direction of the dotted arrow B.

The bristle head 110 includes a first extend head 310 and a second extend head 312. An end of the first extend head 310 is rotatingly pinned to the bristle head 110, in order to permit movement according to the arrow C. An end of the second extend head 312 is rotatingly pinned to the bristle head 110, in order to permit movement according to the arrow C'. Although not shown in detail in FIG. 3, but shown simply in phantom, additional gears 314 and 316 held by the gear rack 308 are formed of or otherwise fixed with the first extend head 310 and the second extend head 312, respectively. The additional gear 314 rotates upon and corresponding to rotation of the lower portion 104 and treble small gears 306*a,b,c*. Also, the additional gear 316 rotates upon and corresponding to the rotation of the lower portion 104 and the dual large gears 304*a,b*. Because the first extend head 310 is connected to the additional gear 314, and the second extend head 312 is connected to the additional gear 316, the first extend head 310 and the second extend head 312 rotate per arrows C and C', respectively, whenever the lower portion 104 is twisted per arrows A or B.

Figure 4:
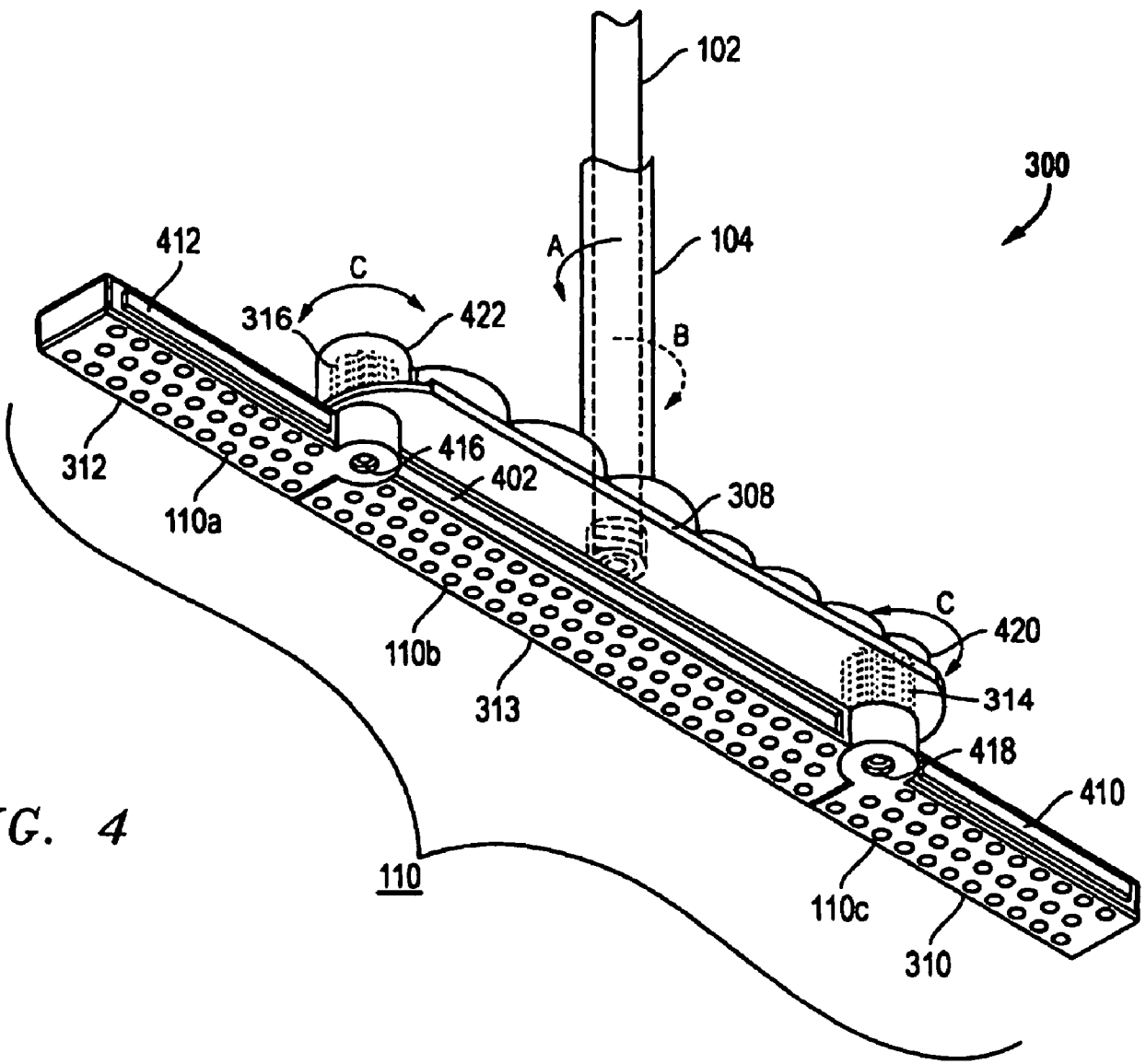
FIG. 4 illustrates a bottom, perspective view of the extension mechanism of FIGS. 2 and 3 of the system of FIG. 1, according to certain embodiments of the invention.

Referring to FIG. 4, an underside of the bristle head 110 shows the first extend head 310 and the second extend head 312 thereof, in fully extended arrangement. The undersides of the bristle head 110, including the first extend head 310 and the second extend head 312, include pluralities of respective bristle fixtures 110*a*, 110*b*, 10*c*. The bristle fixtures 110*a*, 110*b*, 110*c* can hold and maintain bristles 118 (shown in FIG. 1). The bristles 118 as maintained by the bristle head 110 can be packets of several bristles each. The bristles 118, or packets of bristles, as the case may be, are maintained fixed in the bristle fixtures 110*a*, 110*b*, 110*c*. For example, the bristles 118 are fixed in the bristle fixtures 110*a*, 110*b*, 110*c* by glue, hot molding, ties, or other securement devices or mechanisms.

As can be appreciated, numerous bristles 118 can be maintained via the entire bristle head 110, in rows or other configurations for each of the portions of the bristle head 110, including the first extend head 312 and the second extend head 310. When the first extend head 312 and the second extend head 310 are not extended (as shown and discussed hereafter with respect to FIG. 5), the bristles 118 will have a depth of, for example, about 6 rows of bristles or packets of bristles. When the first extend head 312 and the second head 310 are fully extended (as shown in FIGS. 3 and 4), the bristles 118 will have a depth of, for example, about 3 rows of bristles or packets of bristles, extending over the entire elongated extensions of the bristle head 110. Although the bristle 118 arrangement is illustrated for purposes of discussion as rows and packets and so forth, any of a wide variety of bristle 118 arrangements in the bristle head 110 is alternatively possible.

Still referring to FIG. 4, a mid-portion 313 of the bristle head 110, extending a length of the gear rack 308, is fixed lengthwise with a portion of the gear rack 308. The gear rack 308 is also fixed at respective ends thereof with each of the first extend head 310 and the second extend head 312. The first extend head 310 and the second extend head 312 are pivotally attached to the gear rack 308 by respective pivot pins 418, 416. The pivot pins 416, 418 can be rivets, screws and washers, or other similar and relatively freely pivoting connectors.

As shown in phantom, the first extend head 310 is fixed with an internal first gear 314 and the second extend head 312 is fixed with an internal second gear 316. The internal first gear 314 and the internal second gear 316 can be respectively formed from the first extend head 310 or second extend head 312, or otherwise respectively affixed therewith. The internal first gear 314 is maintained within a hood portion 420 at an end of the gear rack 308. The internal second gear 316 is similarly maintained with another hood portion 422 at the other end of the gear rack 308. The hood portions 420, 422, respectively, maintain the internal first gear 314 in rotating connection and cooperation with the dual large gears 304*a,b* (shown in FIG. 3) and the internal second gear 316 in rotating connection and cooperation with the treble small gears 306*a,b,c* (also shown in FIG. 3).

Therefore, whenever the lower portion 104 is twisted, the dual large gears 304*a,b* turn, thereby turning the internal first gear 314 and causing the first extend head 310 to rotate outwardly in the direction of arrow C. Likewise, twist of the lower portion 104 concurrently turns the treble small gears 306*a,b,c*, thereby turning the internal second gear 316 and causing the second extend head 312 to rotate outwardly in the direction of arrow C'. In this manner, the cleaning surface presented by the bristle head 110 and bristles 118 (shown in FIG. 1) are extended to provide a double-wide arrangement. On twisting of the lower portion 104 and consequent rotation of the series of gears, the long pole 102 is opposingly twisted and thereby the gear rack 308 (i.e., fixed with the long pole 102) does not twist with the lower portion 104 but can twist with the long pole 102.

The mid-portion 313 of the bristle head includes along an edge thereof, a groove 402. Each of the first extend head 310 and the second extend head 312 include respective ridges 410, 412, along the respective edges thereof. The groove 402 is sized sufficiently to accept the ridge 410 when the first extend head 310 is not extended, and also is sized sufficiently to accept the ridge 412 when the second extend head 412 is not extended. The groove 402 and ridges 410, 412 maintain the entire bristle head 110 in planar alignment to form a generally planar cleaning surface of bristles 118 (when incorporated in the bristle head 110, as shown in FIG. 1). The pivot pins 418, 416 allow the respective first extend head 310 and the second extend head 312 to pivot outwardly, doubling a width of the entire cleaning surface, yet also continuing to maintain the entire bristle head 110 (with extensions) in planar arrangement to for a less deep but still generally planar surface of bristles 118.

Figure 5:
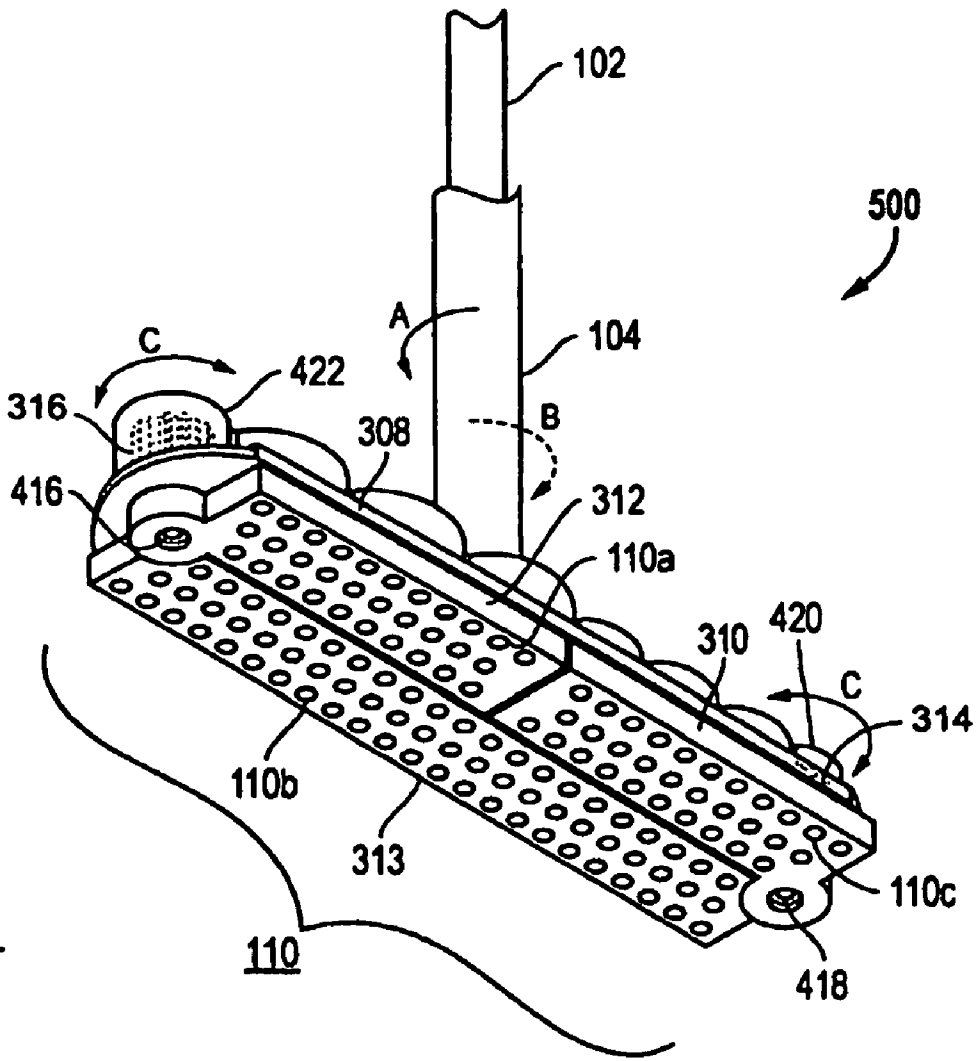
FIG. 5 illustrates a bottom, perspective view of the system of FIG. 1, wherein the extension mechanism maintains a non-extended arrangement, according to certain embodiments of the invention.

Referring to FIG. 5, the bristle head 110 of the system 100 is shown in non-extended arrangement 500. In the arrangement 500, the lower portion 104 has been twisted to cause the gears (e.g., the primary gear 302, the dual large gears 304*a,b*, and the treble small gears 306*a,b,c*) to direct the first extend head 310 and the second extend head 312 under the gear rack 308 and into engaged aside the mid-portion 313 of the bristle head 110. Although not shown in detail in FIG. 5, the groove 402 of the mid-portion 313 accepts the respective ridges 410, 412 of the first extend head 310 and the second extend head 312. The gears, which engage the internal first gear 314 and the internal second gear 316, rotate the internal first gear 314 and the internal second gear 316, causing the affixed first extend head 310 and second extend head 312 to be so positioned.

In the non-extended arrangement 500, the bristle head 110 is about the width of a conventional broom cleaning surface, such as, for example, about 6" to about 24" in width. Because of the engagement of the first extend head 310 and second extend head 312 adjacent the mid-portion 313 in the arrangement 500, the depth (as viewed into the page of FIG. 5) of the bristles 118 is approximately double that of the extended arrangements previously described with respect to FIGS. 2–4.

In operation, the system 100 (shown in FIG. 1) can be used in the extended or non-extended arrangement of the bristle head 110, in typical sweeping manner of a broom or other cleaning implement. In a non-extended arrangement such as shown in FIG. 1, a user manually grasps the handle 100*a*, via the upper and/or lower portions (and possibly even the joint 106*a* or hanger 108), and glides the bristles 118 across a floor or other surface to be cleaned. The bristles 118 contact and push matter to be cleaned and, based on the gliding motion of the bristles 118 provided by the user, moves the matter to be cleaned. Certain of the matter may be caught or retained within and between the bristles 118 of the bristle head 110, but the matter is does not stick (because of the varied cross-sections of the bristles). Other such matter may be merely pushed via a collection of the bristles 118. In any event, the system 100 functions similar to a conventional broom, including having a conventional width of bristle surface.

If the user desires a broader bristle surface for the system 100, the user twists the lower portion 104 with respect to the long pole 102. The user grips the long pole 102 at the hanger 108, and the lower portion 104 at the grip 106. The button 106*a* is depressed to permit the lower portion 104 to be opposingly rotated with respect to the long pole 102. Because the long pole 102 is fixed with the gear rack 308 and head housing 109, the lower portion 104 rotates in relation thereto and thereby rotates the series of gears maintained by the gear rack 308. The twist of the lower portion 104, within the head housing 109, concurrently activates rotation of the dual large gears 304*a,b* and the treble small gears 306*a,b,c*. This respectively rotates the internal first gear 314 and the internal second gear 316. The internal first gear 314, connected to the first extend head 310, swings the first extend head 310 outwardly from underneath the gear rack 308, and into lengthwise alignment with the mid-portion 313 of the bristle head 110. Simultaneously, the internal second gear 316, connected to the second extend head 312, swings the second extend head 312 outwardly from underneath the gear rack 308, and also into opposing lengthwise alignment with the mid-portion 313 of the bristle head. When so extended, a double wide cleaning surface is formed of the bristles 118 of the first extend head 310, the mid-portion 313, and second extend head 312. The bristle 118 depth (as viewed looking into the page of FIGS. 1 and 3–4) of the extended arrangement, however, is about half that of the non-extended arrangement.

In use of the extended arrangement of the system 100, the same or similar manual use is possible. The extended cleaning surface of the system 100 is glided across a surface to be cleaned, manually by the user. The bristles 118 similarly push matter on a floor or other surface to be cleaned, but the matter does not stick to the bristles.

In order to return the extended arrangement of the system 100 to the non-extended arrangement, the user again depresses the button 106*a* of the grip 106 and reverses the twist direction of the lower portion 104 with respect to the long pole 102 fixed with the head housing 109. As in twisting to obtain the extended arrangement of the system 100, the head housing 109 is fixed with the long pole 102 to rotate therewith, and the lower portion 104 is oppositely rotated and consequently turns the series of gears maintained by the gear rack 308. The twisting of the lower portion 104, with respect to the gear rack 308 and long pole 102, activates rotation of the respective gears and causes each of the first extend head 310 and the second extend head 312 to therewith inwardly swing into position under the rack head 308.

Figure 6:
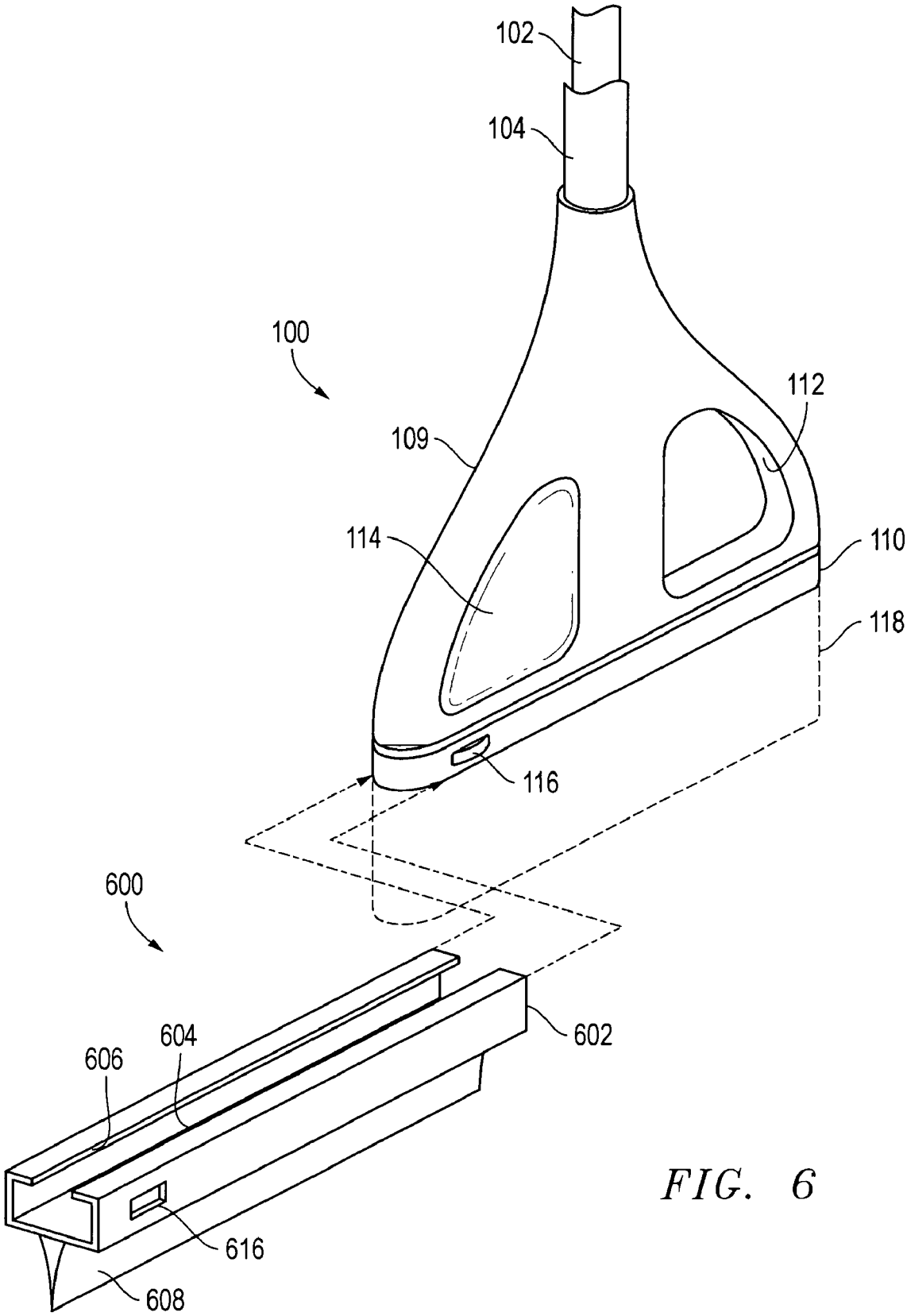
FIG. 6 illustrates an optional element, for example, a squeegee head and blade, for use in the system of FIG. 1, according to certain embodiments of the invention.

Referring to FIG. 6, the system 100 can be equipped with a variety of added features for the same or other uses, such as an optional head 600. For example, a squeegee head 602 can be fixed at the gear rack 308. The squeegee head 602 includes respective ribbed portions 604,606. The squeegee head 602 can be slipped with the ribbed portions 604, 606 along and through grooves formed between the head housing 109 and the bristle head 110. A distance between the ribbed portions 604, 606 of the squeegee head 602 is sufficient for passing therebetween the bristles 118 (shown in phantom). The grippable hole 112 of the head housing 109 can serve as a grip for the user in pushing or fitting the head 602 (or other mechanism). As the squeegee head 600 is passed into place, an eyelet 616 of the squeegee head 602 can mate with the button 116. This holds the squeegee head 602 in securement with the system 100. The squeegee head 602 is fixed with a squeegee blade 608, or other cleaning element as the case may be. A user then can glide the cleaning element, such as the squeegee blade 608, over a surface to perform a varied function with the system 100, such as a fluids squeegee function.

Alternately, other similar heads and apparatus can be employed in similar manner with the system 100. Some examples of other functions and implements include a Swiffer® head (such as, for example, available from Procter & Gamble), a sponge head, a mop head, or other variety of functions and added elements. All may be employed with the system 100 in similar or otherwise easily determined or understood manner.

Moreover, in the extended arrangement of the system 100, with first extend head 310 and second extend head 312 outwardly disposed, a wider head or other function or feature can be employed with the system. In any event, all such additional heads, features, functions, and possibilities are included for purposes of this description.

Figure 7:
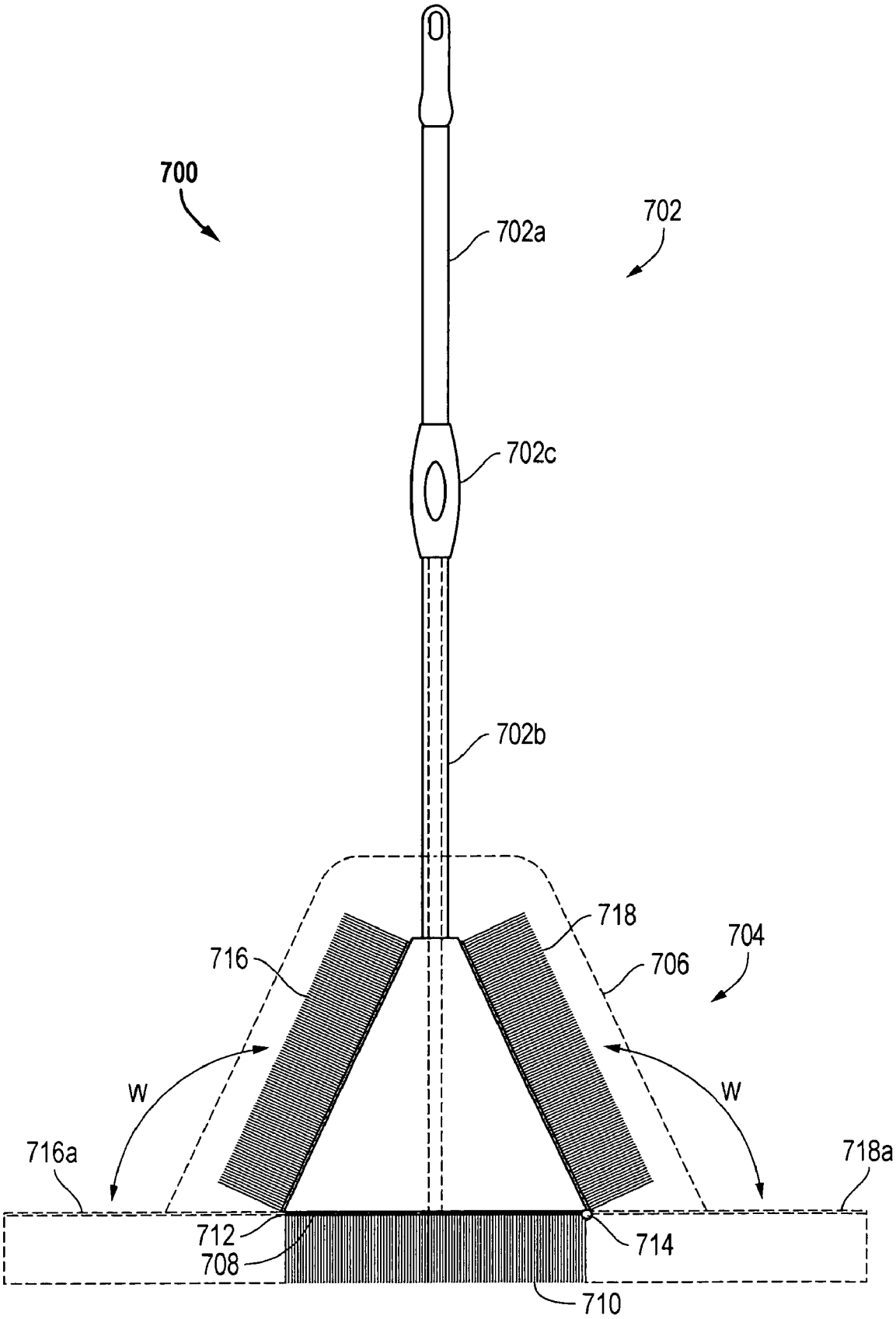
FIG. 7 illustrates an alternative extension mechanism of a system for sweeping, according to certain embodiments of the invention.

Referring to FIG. 7, an alternative cleaning system 700 includes a pole section 702 and a head section 704. The pole section 702 is substantially similar to the foregoing described handle 100*a*, in that it comprises a long pole 702*a* that extends to and connects with the head section 704 and a short section 702*b* that extends through the head section 704 and connects with gears and mechanisms. A grip 702*c* is fixed with the short section 702*b* and includes mechanisms, such as a button, to engage the short section 702*b* with the long pole 702*a* to maintain in fixed concentric relation on rotation. The short section 702*b* is concentrically rotatable with the long pole 702*a* when not in fixed engagement.

The head section 704 includes an outer shroud 706 (shown in phantom) as the housing. The long pole 702*a* fixedly connects to a head structure 708. The head structure 708 forms a first set of bristles 710. At opposing lateral ends of the head structure 708, the head structure 708 has respective pivots 712, 714. At the pivots 712, 714, a first extension 716 and a second extension 718 pivotally connect. Gears or other mechanisms, actuatable by concentrical rotation of the short section 702*b* with respect to the long pole 702*a*, cause the respective first extension 716 and second extension 718 to swing downwardly in the directions of arrows W and W', respectively. In this manner, the first extension 716 and the second extension 718 are positioned as shown in phantom as 716*a* and 718*a*, thereby expanding the cleaning surface laterally.

The first extension 716 and the second extension 718 are retracted by counter twisting of the short section 702*b* with respect to the long pole 702*a*. Locking or engagement buttons or other features, for example, contained in a grip 702*c* or other aspect, maintain the extensions in non-extended or extended state, as desired and applicable.

Figure 8:
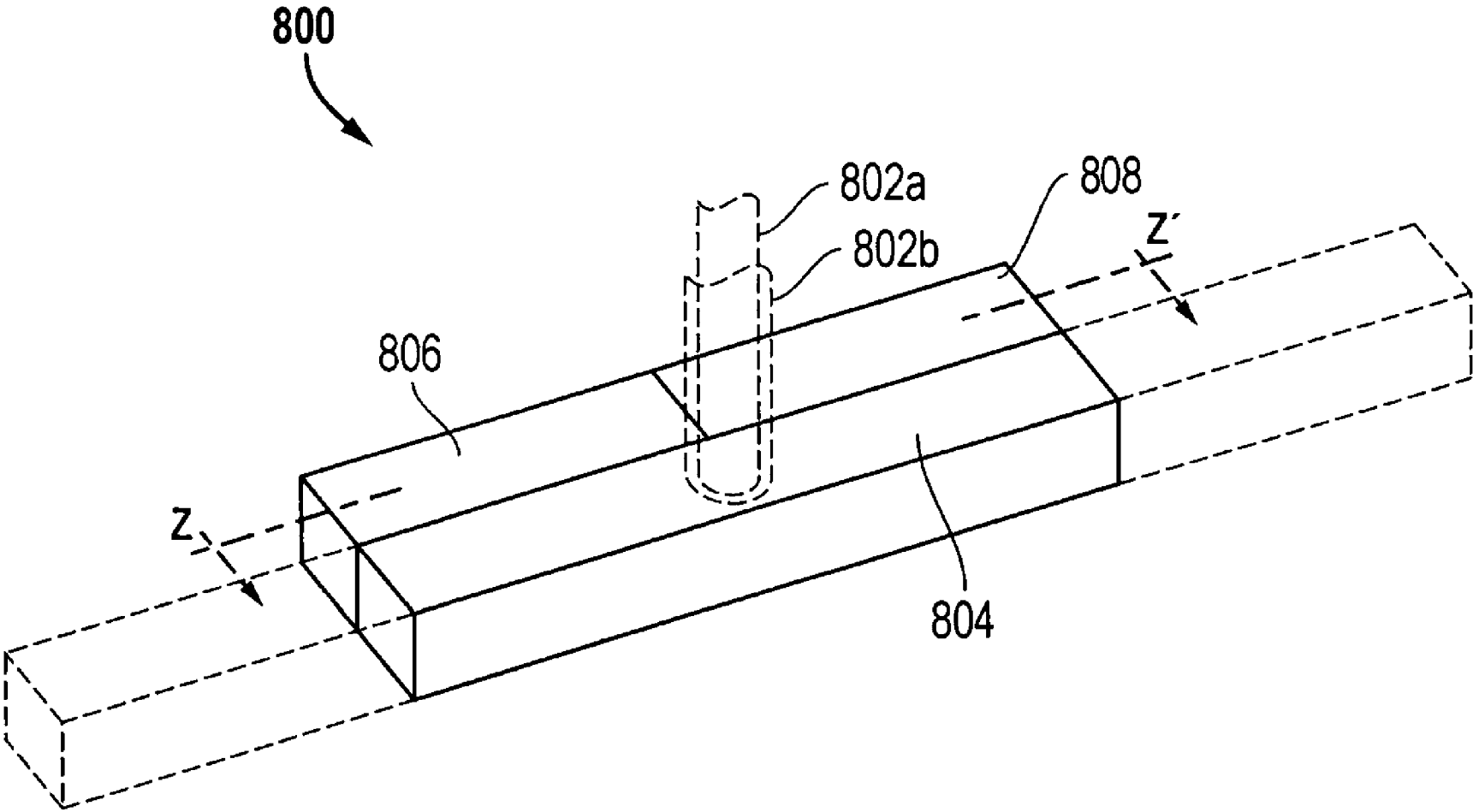
FIG. 8 illustrates another alternative extension mechanism of a system for sweeping, according to certain embodiments of the invention.

Referring to FIG. 8, another alternative expansion head 800 is similarly employed in a cleaning system. A pole 802*a* is concentrically aligned within a slightly larger outer pole 802*b*. The pole 802*a* is fixedly connected to a mid-head portion 804. The outer pole 802*b* is rotatable with respect to the pole 802*a* and the mid-head portion 804. Gears or other similar mechanisms (not shown) connect with and are rotatingly activated by rotation of the outer pole 802*b*. A first extension piece 806 and a second extension piece 808 are connected with and translationally actuatable via the gears or other mechanisms. In the alternative, the first extension piece 806 and the second extension piece 808 remain as shown in FIG. 8, when not extended. When extended, by twisting of the outer pole 802*b* with respect to the pole 802*a* and the mid-head portion 804, each of the first extension piece 806 and the second extension piece 808 are translationally moved, according to dotted lines Z and Z', into extended positions at ends of the mid-head portion 804. In the extended positions (as shown in phantom), the cleaning surface of the system is effectively extended. Retraction into non-extended position is similarly accomplished by counter-rotation of the outer pole 802*b* with respect to the pole 802*a* and mid-head portion 804. Of course, other extension and translation/movements are possible for extension sections of a cleaning system according to the embodiments of the invention and variations thereof.

In the foregoing specification, the invention has been described with reference to specific embodiments. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention.

Benefits, other advantages, and solutions to problems have been described above with regard to specific embodiments. However, the benefits, advantages, solutions to problems and any element(s) that may cause any benefit, advantage, or solution to occur or become more pronounced are not to be construed as a critical, required, or essential feature or element of any or all the claims. As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A system for cleaning, comprising:

a handle;

a head having a cleaning surface, connected to the handle;

wherein the head is extendable to selectively widen the cleaning surface;

wherein the head is contractable to selectively narrow the cleaning surface;

a gear, connected to the handle and operably connected to the head, so that twist of the handle rotates the gear;

wherein rotation of the gear selectively extends the head to selectively widen the cleaning surface;

wherein the reverse rotation of the gear selectively contracts the head to selectively narrow the cleaning surface;

a first series of extension gears operably connected to the gear;

a first head extension operably connected to the first series;

a second series of extension gears operably connected to the gear;

a second head extension operably connected to the second series; and wherein twist of the handle rotates the gear, causing rotations of the first series and the second series, causing the first head extension to laterally extend and causing the second head extension to laterally extend.

* * * * *